United States Patent [19]

Sakamaki et al.

[11] 4,257,753

[45] Mar. 24, 1981

[54] ROTARY FLUID VANE PUMP WITH MEANS PREVENTING AXIAL DISPLACEMENT OF THE DRIVE SHAFT

[75] Inventors: Hiroshi Sakamaki, Utsunomiya; Yoshiyuki Maeda, Ageo; Fumihiro Ushijima; Tadashi Saitou, both of Toyota, all of Japan

[73] Assignee: Toyota Jidosha Kogyo Kabushiki Kaisha, Toyota, Japan

[21] Appl. No.: 2,136

[22] Filed: Jan. 9, 1979

[30] Foreign Application Priority Data

Jan. 27, 1978 [JP] Japan ..... 53-8822

[51] Int. Cl.[3] ..... F04C 5/00; F04C 15/00; F04C 27/00

[52] U.S. Cl. ..... 418/133; 418/153

[58] Field of Search ..... 418/131-135, 418/152, 153, 156

[56] References Cited

U.S. PATENT DOCUMENTS

| | | | |
|---|---|---|---|
| 2,787,959 | 4/1957 | Jeannin et al. | 418/131 |
| 2,833,465 | 5/1958 | Cable | 418/152 |
| 3,024,736 | 3/1962 | Erdmann | 418/133 |
| 3,664,776 | 5/1972 | Mills et al. | 418/133 |
| 4,072,450 | 2/1978 | Carlson | 418/133 |

FOREIGN PATENT DOCUMENTS

| | | | |
|---|---|---|---|
| 862662 | 3/1961 | United Kingdom | 418/135 |

*Primary Examiner*—John J. Vrablik

*Attorney, Agent, or Firm*—Sughrue, Rothwell, Mion, Zinn and Macpeak

[57] ABSTRACT

A rotary fluid pump has a stator housing with a generally cylindrical cavity extending therethrough and a pair of recessed end heads assembled at opposite ends of the housing to form a pump cavity therewith. A drive shaft is journalled in the end heads by bearings and extending eccentrically into the interior of the pump cavity and a rotor is mounted on the drive shaft within the pump cavity. A pair of sealing plates of different thickness are individually disposed between the ends of the stator housing and the end heads to divide the pump cavity into a pair of end chambers defined by the end head recesses and the plates and an intermediate rotor chamber defined by the plates. A plurality of vanes are slidably disposed in an equal plurality of grooves radially formed in the rotor. The drive shaft is constrained to prevent axial displacement by stoppers, washers or a combination thereof mounted on the shaft and contacting bearings that support the shaft. The bearings are fixed to one end head.

9 Claims, 4 Drawing Figures

ROTARY FLUID VANE PUMP WITH MEANS PREVENTING AXIAL DISPLACEMENT OF THE DRIVE SHAFT

BACKGROUND OF THE INVENTION

This invention relates to a rotary fluid pump, and more particularly, to a type thereof which prevents a drive shaft from axial displacement. A conventional rotary fluid pump includes a stator housing having a generally cylindrical bore extending therethrough and a pair of end heads assembled at the opposite ends of the housing to cover the end heads of the bore and form a cavity. Each end head has a recess therein contiguous with the bore and a drive shaft journalled in at least one of the end heads and extending into the interior of the cavity eccentrically relative to the wall of the bore. A rotor is mounted on the drive shaft within the cavity, and a pair of side plates disposed one between each end of the stator housing and the adjacent end head divide the cavity into a pair of end chambers defined by the end head recesses and the plate. A plurality of vanes are slidably disposed in the rotor along the radial direction thereof to permit intake, compression and discharge of a fluid in cooperation with the rotor chamber by the radially outward movement of the vanes.

According to this type of device, inner peripheral surfaces of the side plates are required to be in contact with the side faces of the rotor to maintain the seal therebetween during rotation of the rotor. However, in this type, no special means is provided to prevent axial displacement of the drive shaft and the rotor merely engages the drive shaft by a spline or key. Therefore, the rotor may accidentally be moved along the axial direction thereof.

If the side plates follow the rotor movement, the seal between the side plates and the end faces of the rotor can be maintained. However, in fact, the side plate cannot sufficiently follow the axial movement of the rotor, so that it would be rather difficult to maintain seal between the side plates and the end faces of the rotor during such movement.

SUMMARY OF THE INVENTION

It is therefore, an object of this invention to overcome the above-mentioned drawbacks of the prior art and to provide an improved rotary fluid pump that eliminates axial displacement of the drive shaft by fixedly securing the rotor to the shaft.

It is another object of this invention to provide an improved rotary fluid pump that has improved performance yet is economical to manufacture.

These objects are attained in accordance with the present invention by providing a stopper on the drive shaft to permit surface engagement with an axially inner side face of a bearing which supports the drive shaft, while the axially outer side face of the bearing is in surface engagement with a fixing means to thereby prevent the drive shaft from its axial displacement. Further, with this structure, one of the end surfaces of the rotor is in close contact with one of the side plates whose thickness is larger than that of the other side plate to provide excellent sealability.

DETAILED DESCRIPTION OF THE INVENTION

Figure 1:
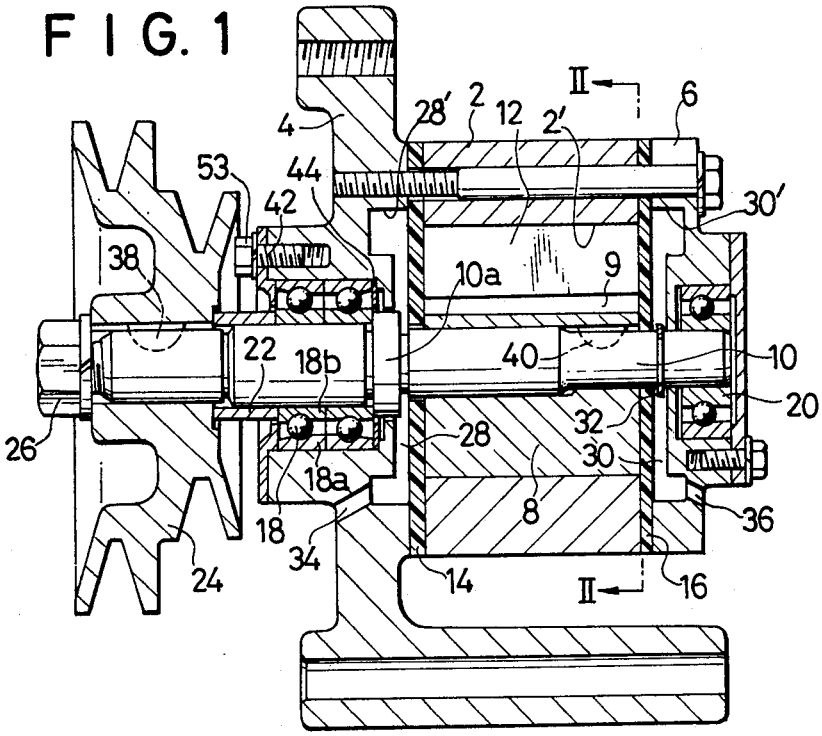
FIG. 1 is a cross-sectional view of a first embodiment according to the present invention.
Figure 2:
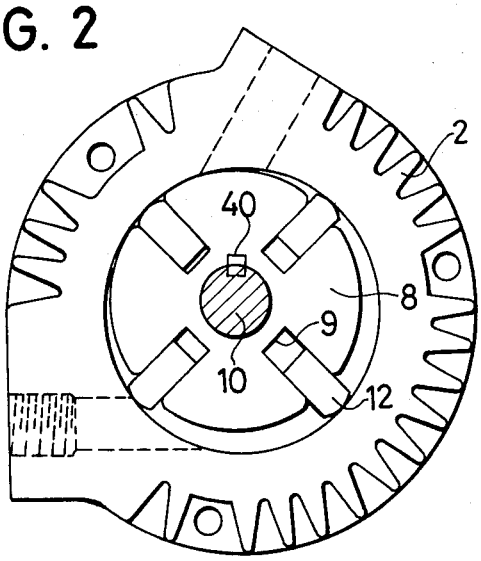
FIG. 2 is a cross-sectional elevation taken along the line II—II of FIG. 1.

A first embodiment according to this invention is shown in FIGS. 1 and 2, wherein a rotor 8 is eccentrically mounted on a drive shaft 10 by a crescent key 40 in a rotor chamber defined by a stator housing 2 and end heads 4 and 6. Alternatively, the rotor is mounted on the shaft by a pin, adhesive materials, or is force-fitted therewith. A plurality of grooves 9 are radially formed as shown in FIG. 2 to receive an equal number of vanes 12 therein. The vanes 12 slide radially outwardly in the grooves by centrifugal force and fluid pressure due to the rotation of the rotor 8. The positions are shown in FIG. 2. Side ends surfaces of the vanes 12 are in surface contact with side plates 14, 16, each secured between the stator housing 2 and end heads 4 and 6. The radially outermost end surface of the vane 12 is in surface contact with an inner peripheral surface of the stator housing 2. As a result the steps of fluid intake, compression and discharge are accomplished in a well known manner.

Each end head is formed with a recess at the interior thereof to provide end chambers 28 and 30 by the end head and the counterfacing side plates 14 and 16. Reference numerals 34 and 36 designate ports for introducing air into the end chambers 28 and 30.

The drive shaft 10 is rotatably supported by bearings 18 and 20 disposed in the end heads 4 and 6, respectively. The shaft 10 is integrally formed with a bearing support or stopper **10*a* having a larger diameter than that of the shaft. The axially inner side face of the bearing 18 is in contact with the stopper 10*a*, while axially outer side face of the bearing 18 is in contact with a shaft-fixing means. The shaft fixing means comprises a grease sealing plate 42 disposed on the shaft 10 and fixed to the end head 4, a cylindrical member 22 disposed on the shaft and a V-pulley 24 secured to the shaft 10 by a crescent key 38. These parts are secured at a predetermined position by a nut 26 threadingly engaged with one end of the shaft 10**.

The drive shaft has a washer member 32 affixed to it to prevent wear particles from the vanes 12 from entering into the end chamber 30 and the bearing structure 20. Although some clearance is established between the drive shaft 10 and the central bore of the sealing plate 16, the washer acts as an effective impediment to such migration of wear particles.

A second grease sealing plate 44 is disposed to contact with the axially inner side face of the bearing 18. The grease sealing plates 42 and 44 serve to determine the relative position of the bearing 18 and the drive shaft 10 as well as serve to prevent grease leakage from the bearing 18.

In assembling the device of this invention, double bearing 18 is disposed on the shaft 10 to contact a part of an inner ring **18*b* of the axially inner side of the bearing 18 with the bearing stopper 10*a* having larger diameter than that of the shaft. Then the grease sealing plate 42 is disposed on the shaft 10 to contact the axially outer side face of the double bearing 18. More specifically, the inner peripheral end portion of the seal plate 42 is in contact with an outer ring 18***a* of the bearing 18 and the outer peripheral end portion of the sealing plate 42 is fixedly secured to the end head 4 by a bolt 53. This will position the bearing at a predetermined position as well as prevent the shaft from leftward movement in the drawing.

Thereafter, a cylindrical member 22 is disposed on the shaft 10 to contact the inner planner end of the member 22 with the inner ring 18*b* of the axially outer side face of the bearing 18. Then the V-pulley is disposed on the shaft 10 to contact the outer planer end of the cylindrical member 22. One end of the shaft is formed with a thread to threadingly engage a nut 26 to fasten the pulley 24 and the cylindrical member 22 to thus prevent the shaft 10 from its rightward movement in the drawing.

As is well known, according to the conventional device, a minute clearance is provided between the side face of the rotor and the sealing plates to allow the sealing plate to follow the movement of the drive shaft and the rotor along axial direction thereof. However, according to the present invention, since the axial movement of the drive shaft and the rotor is substantially prevented, the clearance is not necessarily required. Instead, the rotor is fixed to the drive shaft to closely contact the sealing plate with the side face of the rotor in order to obtain excellent sealability therebetween.

According to the embodiment of this invention, the thickness of the sealing plates 14 and 16 are about 3 mm and about 2 mm, respectively. The thick sealing plate 14 has the thickness of 1.1 to 2.0 times larger than that of the thin sealing plate 16. If the thickness of the sealing plate 14 is 1.1 times less larger than that of the plate 16, it is difficult to provide zero-clearance space between the plate 14 and the side face of the rotor due to a lack of elastic modulus of the plate 14. If the thickness of the plate 14 is 2.0 times more larger than that of the plate 16, the sealing plate 14 may not sufficiently follow the axial displacement of the rotor due to the large elastic modulus of the plate 14. This tends to deteriorate sealability.

Furthermore, in order to ensure better functioning of the sealing plates 14 and 16, inner peripheral surfaces 28' and 30' of the end chambers are not in alignment with an inner peripheral surface 2' of the stator housing 2. Rather, the surfaces 28' and 30' are positioned radially outwardly from the inner peripheral surface 2'. With this structure, and sealing plates, in response to accidental axial displacement of the rotor will follow such displacement.

Figure 3:
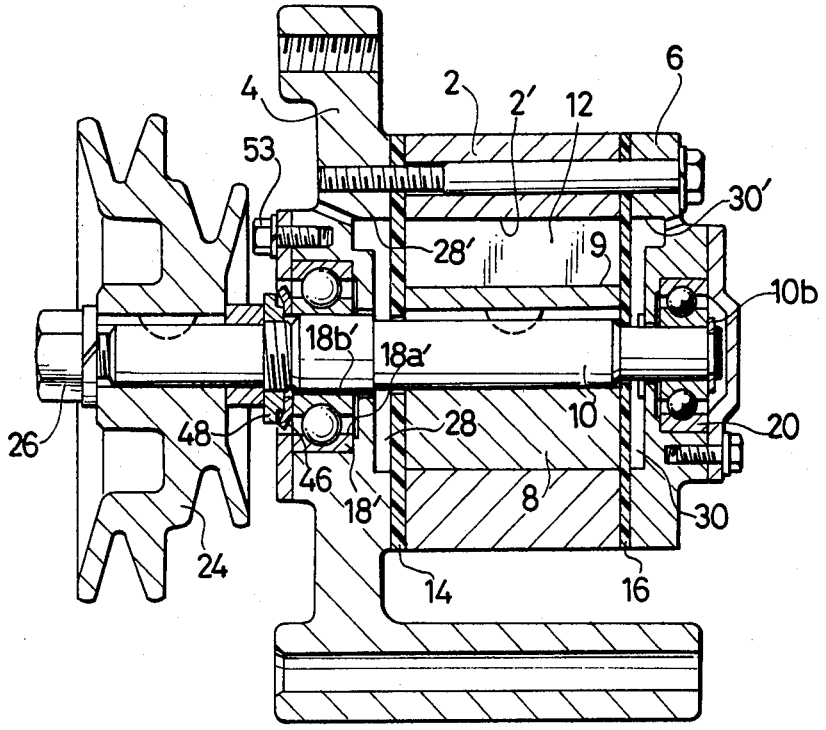
FIG. 3 is a cross-sectional view of a second embodiment according to the present invention.
Figure 4:
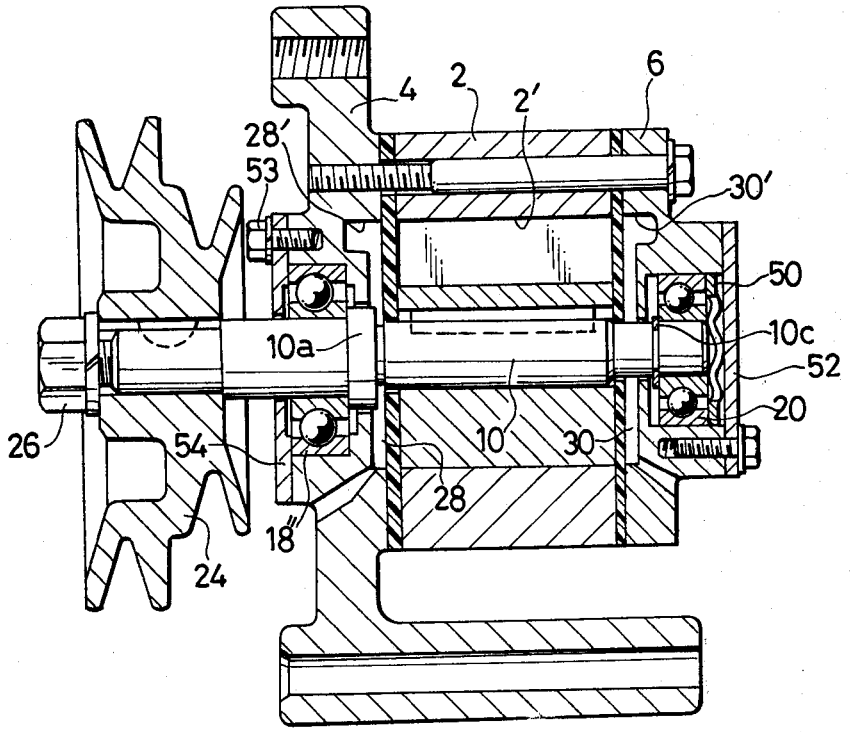
FIG. 4 is a cross-sectional view of a third embodiment according to the present invention.

Second and third embodiments of this invention are shown in FIGS. 3 and 4, respectively, wherein like parts and components are designated by the same reference numerals and characters as those shown in the first embodiment.

In FIG. 3, instead of employing a bearing stopper 10*a* shown in FIG. 1, a stop washer 10*b* is disposed on the other end of the drive shaft 10 and a stop washer 46 and a lock nut 48 threadingly engaged with the shaft are provided to support the inner ring 18*b'* of the bearing 18'. The outer ring 18*a'* of the bearing 18' is secured to the end head by a bolt 53 and a moderate thrust load is applied to the bearing 18'.

In FIG. 4, a stop washer 10*c* is disposed on the drive shaft to contact an inner ring of the axially inner side of the bearing 20 in order to prevent rightward movement of the shaft. The axially outer side of the bearing 20 is supported by a bearing cover 52 via an annular corrugated spring 50 in contact with the outer ring of the bearing 20.

Furthermore, a plate member 54 is secured to the end head by a bolt 53 to support outer ring of the axially outer side of the bearing 18''. The inner ring of the axially inner side face of the bearing 18'' is supported by the bearing stopper 10*a* as in the first embodiment.

In the second and the third embodiments, though the inner peripheral surface of the end chambers are in alignment with the inner peripheral surface of the stator housing, approximately the same function as the sealing plates are obtainable as those obtained in the first embodiment.

It is apparent that other modifications are possible without departing from the essential scope of this invention.

What is claimed is:

1. A rotary fluid pump comprising; a stator housing having a generally cylindrical cavity extending therethrough, a pair of recessed end heads assembled at opposite ends of the housing to form a pump cavity therewith, a drive shaft journalled in said end heads and extending eccentrically into the interior of the pump cavity, a rotor fixedly mounted on the drive shaft within the pump cavity, a pair of sealing plates individually disposed between the ends of the stator housing and the end heads to divide the pump cavity into a pair of end chambers defined by the end head recesses and the plates and an intermediate rotor chamber defined by the plates, said sealing plates of different thickness and said rotor contacts the sealing plate thicker than the other sealing plate, a plurality of vanes slidably disposed in an equal plurality of grooves radially formed in the rotor, and means to prevent axial displacement of said drive shaft along the axis of rotation thereof.

2. The device as defined in claim 1, wherein said thick sealing plate has a thickness in the range of 1.1 to 2.0 times larger than that of said other sealing plate.

3. The device as defined in claim 1 wherein said drive shaft is supported by a pair of bearing means at positions outside pump cavity, and said means to prevent axial displacement comprises a pair of washers disposed on said drive shaft outside of each bearing means, and means to secure at least one of said bearing means to end face.

4. The device as defined in claim 1, wherein said drive shaft is supported by bearing means and said means to prevent axial displacement comprises a bearing stopper disposed on said shaft and contacting said bearing means and means to secure said bearing means to an end head to position said bearing means and prevent axial displacement of said drive shaft.

5. The device as defined in claims 1 or 4 wherein said end chambers have respective inner peripheral surfaces and said inner peripheral surfaces are positioned radially outward from an inner peripheral surface of said stator housing.

6. The device as defined in claim 4 further comprising a cylindrical member disposed on said drive shaft having an end in contact with said bearing means and pulley means mounted on said drive shaft and contacting the other end of said cylindrical member.

7. The device as defined in claim 4, wherein said bearing stopper has a larger diameter than that of the drive shaft, an inner ring of said bearing being in surface contact with said larger diameter portion.

8. The device as defined in claim 4 wherein said bearing means comprises first and second bearing assembles and said means to prevent displacement comprises a stop washer disposed on an inner side of one bearing assembly, bearing cover disposed on the outer side of said one bearing assembly and means to bias said cover against said one bearing assembly.

9. The device of claim 8 wherein said second bearing assembly is secured by said means to secure said bearing means, and said biasing means comprises a corrugated spring.

* * * * *